252-103 AU 157 EX
6/11/85 XR 4,522,738

United States Patent [19]
Magid et al.
[11] Patent Number: 4,522,738
[45] Date of Patent: Jun. 11, 1985

[54] TOILET BOWL CLEANER

[76] Inventors: David J. Magid, 40 Woodview Dr., Doylestown, Pa. 18901; W. Thomas Ruckle, 706 Deerbrook Rd., Bel Air, Md. 21014

[21] Appl. No.: 488,770

[22] Filed: Apr. 26, 1983

[51] Int. Cl.[3] ..... C11D 17/04

[52] U.S. Cl. ..... 252/90; 252/100; 252/103; 252/142; 252/157; 252/174; 206/0.5; 206/219; 15/208

[58] Field of Search ..... 252/90, 174, 100, 103, 252/142, 157, 174.14, 550, 547, 174.21; 206/219, 0.5; 15/208

[56] References Cited

U.S. PATENT DOCUMENTS

| | | | |
|---|---|---|---|
| 2,497,057 | 2/1950 | Pape et al. | 252/157 |
| 2,560,649 | 7/1951 | Hornaday | 252/157 |
| 3,198,740 | 8/1965 | Dunlop et al. | 252/90 |
| 3,300,546 | 1/1967 | Baechtold | 525/57 |
| 3,322,674 | 5/1967 | Friedman | 252/90 |
| 3,362,776 | 1/1968 | Knoir | 401/8 |
| 3,374,195 | 3/1968 | Bianco et al. | 524/376 |
| 3,413,229 | 11/1968 | Bianco et al. | 252/90 |
| 3,516,937 | 6/1970 | Story et al. | 252/110 |
| 3,528,921 | 9/1970 | Gray | 252/99 |
| 3,595,798 | 7/1971 | Smith et al. | 252/95 |
| 3,629,140 | 12/1971 | Bayless et al. | 427/213.31 |
| 3,638,786 | 1/1972 | Borecki et al. | 206/219 |
| 3,769,224 | 10/1973 | Inamorato | 252/157 |
| 3,892,905 | 7/1975 | Albert | 428/220 |
| 4,115,292 | 9/1978 | Richardson et al. | 252/90 |
| 4,124,521 | 11/1978 | Jedzinak | 252/127 |
| 4,145,184 | 3/1979 | Brain et al. | 8/137 |
| 4,188,447 | 2/1980 | Ehlenz | 428/290 |
| 4,234,442 | 11/1980 | Cornelissens | 252/90 |
| 4,286,016 | 8/1981 | Diamond et al. | 206/0.5 |
| 4,288,225 | 9/1981 | Roland | 8/137 |
| 4,289,815 | 9/1981 | Lee | 428/35 |

*Primary Examiner*—Paul Lieberman
*Assistant Examiner*—Hoa Van Le

[57] ABSTRACT

Toilet bowl cleaners having inner and outer water-soluble envelopes are disclosed. The inner envelope contains a basic material and the outer envelope contains both the inner envelope and an acidic material. In use, the outer envelope dissolves and thereby releases the acidic material to clean the toilet bowl. The inner envelope then dissolves thereby releasing the basic material contained therein to neutralize the toilet bowl water.

18 Claims, No Drawings

TOILET BOWL CLEANER

BACKGROUND OF THE INVENTION

Commercially-available liquid toilet bowl cleaning compositions generally incorporate mineral acids such as hydrochloric, sulfuric or phosphoric acid. A typical product might contain about 5–35% hydrochloric acid. In response to the danger associated with such liquid acid compositions, such as spillage onto substrates other than those intended for cleaning, skin burns or irritation, deleterious effects upon metals, accidental ingestion and the like, bowl cleaning compositions formulated as mixtures of solids were developed. These compositions incorporated acidic active ingredients such as sodium bisulfate, sulfamic acid, oxalic acid or citric acid in combination with surfactants, disinfectants, dyes and perfumes. Solid compositions are considered to be safer to use. However, solid toilet bowl cleaning compositions present the problem of over- or underuse due to measuring difficulties.

In an attempt to overcome these difficulties, acidic bowl cleaning compositions have been provided in unit application water-soluble pouches or envelopes. An envelope of the composition would be introduced into the bowl water and the resultant solution spread around the inner bowl surfaces with a bowl mop, often after allowing the cleaning composition to stand in the water without agitation. Manual agitation of the dissolved cleaning chemicals has heretofore been the primary means used to remove the ring of scale which forms predominantly at or slightly above the bowl water level, and which consists primarily of rust, grease and deposited salts.

Therefore, it is an object of the present invention to provide a toilet bowl cleaner which is self-starting, that is, which agitates and/or foams the bowl water upon dissolution therein, thereby wetting and aiding the removal of scale deposits located above the water line of the bowl.

It is another object of the present invention to provide a toilet bowl cleaner comprising a packaged, self-neutralizing composition, that is, one which is formulated and packaged so that the acidic component is neutralized after the period in which it performs its cleaning function, thus rendering the bowl contents non-toxic and non-corrosive.

It is yet another object of the present invention to provide a toilet bowl cleaner comprising a self-neutralizing composition which indicates when it is in the acidic state and when it is in the neutral or basic state.

Other objects, advantages and novel features of the present invention will be apparent to those skilled in the art from the following description and appended claims.

BRIEF DESCRIPTION OF THE INVENTION

The objects of the present invention are achieved in one embodiment thereof by a toilet bowl cleaner comprising a single water-soluble envelope having therein a mixture of a solid acidic material and a solid basic material which interact with the bowl water upon dissolution of the envelope to release carbon dioxide gas in an amount sufficient to agitate the bowl water and thus to enhance the cleaning process. The amount and type of the acidic material is selected so that its neutralization equivalents exceed the neutralization equivalents provided by the basic material. Thus, after the agitation ceases, the bowl water remains acidic and continues to cleanse the surfaces which it has wetted.

Optionally, the acidic cleaning compositions of this type will incorporate an amount of surfactant effective to foam the bowl water during the carbon dioxide-producing neutralization period. The foam thus formed effectively raises the bowl water level and aids the removal of scale deposits occurring above the bowl water level.

In another embodiment of the present invention, a toilet bowl cleaner is provided which comprises an outer, water-soluble envelope which contains a solid acid material and an inner, water-soluble envelope which contains an amount of a solid, basic material adequate to at least neutralize the acidic material. Upon rupture or dissolution of the outer envelope, the acidic material is released into the bowl water. The acidified bowl water may then be manually spread onto bowl surfaces above the bowl water level. The bowl water may also be agitated and/or foamed by the admixture of a minor amount of the basic material and optional surfactant with the acidic material in the outer envelope.

The wall thickness of the inner envelope is adjusted so that after a suitable time it ruptures or dissolves to release a neutralizing amount of the basic material into the bowl water. A minor portion of the acid, as well as a part or all of the surfactant, may optionally be admixed with the basic component within the inner envelope to enhance the agitation and foaming of the bowl water when the contents of the inner envelope are released. The inner envelope may also incorporate an amount of an acid-base indicator or dye effective to show the user when neutralization has been completed and the bowl may be flushed.

DETAILED DESCRIPTION OF THE INVENTION

The compositions used in the toilet bowl cleaners of the present invention are packaged, preferably in unit application portions, within at least one sealed, water-soluble envelope, pouch or bag. These envelopes are formed of cold water-soluble polymeric films.

Suitable water-soluble polymeric films are those formed from polyvinyl alcohol, preferably plasticized; methyl cellulose; a carboxymethyl cellulose such as sodium carboxymethyl cellulose; sodium carboxymethyl-hydroxymethyl cellulose, a film derivative of polyethylene glycol, or the like. Polyvinyl alcohol films are preferred for both the outer and inner envelopes of the present cleaners, and particular formulations are disclosed in U.S. Pat. Nos. 3,413,229; 3,892,905; 3,374,195 and 3,300,546, the disclosures of which are incorporated by reference herein.

The acidic, self-starting cleaning compositions of the present invention are contained within a single, hermetically-sealed, water-soluble envelope. When formed from a polyvinyl alcohol film, the wall thickness of this envelope may be adjusted over a wide range in order to achieve adequate strength for shipping and storage as well as to achieve rapid dissolution of the envelope when it is introduced into the bowl water. To achieve these ends, a wall thickness of 0.25–5 mil (millimeters) is employed, preferably 0.5–3 mil, most preferably 1–2 mil.

When a double-envelope system is employed to sequentially deliver components of the present cleaning compositions, the film forming the outer envelope is preferably selected so as to be substantially thinner than that used for the inner pouch. The greater the difference in thickness between the two envelope walls, the longer will be the time lapse between the opening of the outer and inner envelopes. While the walls of the outer envelope are preferentially sized so as to dissolve in less than about 1 minute at ambient water temperatures, a time lapse of at least about 2 minutes between the rupture of the outer and inner envelopes is preferred to provide the user with the opportunity to perform any manual cleaning operations before the neutralizing material is released. Preferably the inner envelope is formed of a polyvinyl film having a thickness of about 1.5–3 mil while the outer envelope thickness is about 1–2 mil.

The outermost envelope of either the single- or double-envelope cleaner system is preferably enveloped in a moisture impermeable overwrap to protect the polyvinyl alcohol envelope from the deleterious effects of environmental moisture or against tearing or puncture during shipping. Suitable overwrap containers may be formed from polyethylene, metal foil or the like.

One embodiment of the toilet cleaners of the present invention comprises a single water-soluble envelope having therein a mixture of a solid acidic material and a solid basic material which interact upon dissolution or rupture of the envelope in the bowl water to release carbon dioxide gas so as to agitate the bowl water and enhance the cleaning action of the acidic component. A stoichiometric excess of the acidic material is provided so that the bowl water remains acidic and so retains substantial cleaning capacity upon standing or when later spread over the bowl surfaces by the user. The term "stoichiometric excess" means that the neutralization equivalents of an acid or base exceed those of the base or acid, respectively, with which it is reacted.

The single-envelope cleaners of the present invention will also preferably comprise a surfactant in an amount effective to foam the bowl water upon the interaction of the acidic and basic materials. The foam functions to raise the bowl water level to about 0.5–1.0 inches or more above its normal level, thus wetting the scale ring and aiding in its removal.

Acidic materials useful in both the one-envelope and two-envelope toilet bowl cleaners are selected from the general classes of organic acids and the metal salts of strong inorganic acids. Useful organic acids are oxalic, citric, sulfamic, tartaric and glutaric acids and the like, with citric acid being preferred due to its low toxicity. Of the acid salts, sodium bulsufite and sodium bisulfate are preferred. When used as a component of the one-envelope acidic cleaners, the acid or mixture of acids will preferably comprise about 60–80% by weight of the cleaning composition. Thus, an effective cleansing unit for a standard toilet bowl (96 ounces of water, 60° F., inside water-level diameter 6.75 inches) would comprise about 30–70 grams of sodium bisulfate or about 25–70 grams of sodium bisulfate plus about 10–50 grams of citric acid.

The ratio of the neutralization equivalents provided by the acidic material to the neutralization equivalents provided by the basic material is preferably selected to be about 5–1.25:1, most preferably about 4–1.35:1, and the pH of the bowl water after treatment will preferably fall within the range of about 1.75–2.25.

The basic material employed in both the single- and double-envelope cleaners is preferably selected from a carbonate, bicarbonate or sesquicarbonate salt, e.g., mixtures of sodium carbonate and sodium bicarbonate, or the corresponding potassium salts.

When used as a component of the one-envelope toilet bowl cleaners, the basic salts will typically comprise about 20–45% by weight of the cleaning composition. Thus an effective cleansing unit for a standard toilet bowl would comprise a mixture of about 5–20 grams of sodium carbonate and about 5–20 grams of sodium bicarbonate.

If a surfactant is employed as a component of either the one-envelope or two-envelope bowl cleaner it has been found preferable to employ a mixture of carbonate and bicarbonate wherein the carbonate provides the greater portion of the neutralization equivalents, preferably about twice the number provided by the bicarbonate. It has been found that this ratio of carbonate to bicarbonate equivalents provides the optimal combination of the production of a large amount of foam which is fine-celled and thus effectively wets the bowl surfaces which it contacts.

The bowl cleaners of the present invention will optionally comprise a foam-forming amount of a surfactant which acts to foam the bowl contents upon generation of the carbon dioxide gas, which gas provides the necessary agitation. In two-envelope cleaner systems, surfactant may be included in the inner envelope and/or in the outer envelope in those systems in which a portion of the basic material is included therein. Sticky or liquid surfactants are preferably preabsorbed onto particles of basic salt for handling ease.

Foam-forming surfactants suitable for use in the instant packets include a wide variety of water-soluble organic detergents and wetting agents which are stable in the presence of the acidic and basic materials. Such detergents may be anionic detergent salts having alkyl substituents of 8 to 22 carbon atoms such as the water-soluble higher fatty acid alkali metal soaps, e.g., sodium myristate and sodium palmitate; water-soluble sulfated and sulfonated anionic alkali metal and alkaline earth metal detergent salts containing a hydrophobic higher alkyl moiety (typically containing from about 8 to 22 carbon atoms) such as salts of higher alkyl mono or polynuclear aryl sulfonates having from about 10 to 16 carbon atoms in the alkyl group (e.g., sodium dodecylbenzenesulfonate, magnesium tridecylbenzenesulfonate, lithium or potassium pentapropylenebenzenesulfonate); alkali metal salts of higher alkyl naphthalene sulfonic acids; sulfated higher fatty acid monoglycerides such as the sodium salt of the sulfated monoglyceride of coconut oil fatty acids and the potassium salt of the sulfated monoglyceride of tallow fatty acids; alkali metal salts of sulfated fatty alcohols containing from about 10 to 18 carbon atoms (e.g., sodium lauryl sulfate and sodium stearyl sulfate); alkali metal salts of higher fatty acid esters of low molecular weight alkylol sulfonic acids, e.g., fatty acid esters of the sodium salt of isethionic acid; the fatty ethanolamide sulfates; the fatty acid amides of amino alkyl sulfonic acids, e.g., lauric acid amide of taurine; as well as numerous other ionic organic surface active agents such as sodium toluene sulfonate, sodium xylene sulfonate, sodium naphthalene sulfonate, sodium toluene sulfonate; and mixtures thereof. In general these organic surface active agents are employed in the form of their alkali metal salts or alkaline earth metal salts as these salts possess the requisite stability, solubility, and low cost essential to practical utility.

The use of amphoteric, cationic and non-ionic detergents is also contemplated by the present invention. These detergents should, of course, be employed in a compatible proportion and manner, e.g., in encapsulated form, if appropriate.

Examples of amphoteric detergents which may be employed include the fatty imidazolines, such as 2-coco-1-hydroxyethyl-1-carboxymethyl-1-hydroxylimidazoline and similar products made by reacting monocarboxylic fatty acids having chain lengths of 10 to 24 carbon atoms with 2-hydroxy ethyl ethylene diamine and with monohalo monocarboxylic fatty acids having from 2 to 6 carbon atoms, the fatty beta-alanines such as dodecyl beat-alanine, the inner salt of 2-trimethylamino lauric acid, betaines such as N-dodecyl-N,N-dimethylamino acetic acid, and the like. Mixtures of any two or more of the foregoing may be employed.

A wide variety of cationic surface active agents may be employed in the compositions of the present invention, including the preferred (higher alkyl)(dimethyl)-benzyl- or (substituted)benzyl ammonium salts wherein the (higher)alkyl group is a $C_{10}$–$C_{20}$-n-alkyl moiety, preferably a $C_{12}$–$C_{18}$-n-alkyl moiety. This class of cationic surfactants is especially preferred for inclusion in the present cleaning compositions since certain mixtures of its members act to substantially disinfect the bowl water. Members of this class include stearyl(dimethyl)-benzyl ammonium chloride, coco (dimethyl)benzyl ammonium chloride, lauryl(dimethyl)benzyl ammonium chloride, the corresponding dimethyl(ethylbenzyl) salts and the like. Other useful cationic surfactants include dicoco (dimethyl) ammonium chloride, cetylpyridinium chloride, cetyltrimethyl ammonium bromide, the stearyl amine salts that are soluble in water such as stearyl amine acetate and stearyl amine hydrochloride, stearyl-dimethylamine hydrochloride, distearyl amine hydrochloride, octyl phenoxyethoxyethyl(dimethylbenzyl) ammonium chloride, decyl pyridinium bromide, the pyridinium chloride derivative of the acetylaminoethyl esters of lauric acid, lauryl trimethyl ammonium chloride, decylamine acetate. Mixtures of two or more cationic surface agents may be employed if desired.

Nonionic surface active agents which may be employed include the ethylene oxide esters of alkyl phenols such as (nonylphenoxy)polyoxyethylene ether, the ethylene oxide ethers of fatty alcohols such as tridecyl alcohol polyoxyethylene ether, the ethylene oxide ethers of alkyl mercaptans such as dodecyl mercaptan polyoxyethylene thioether, the ethylene oxide esters of acids such as the lauric ester of polyethylene glycol and the lauric ester of methoxy polyethylene glycol, the ethylene oxide ethers of fatty acid amides, the condensation products of ethylene oxide with partial fatty acid esters of sorbitol such as the lauric ester of sorbitan polyethylene glycol ether, and other similar materials, wherein the mole ratio of ethylene oxide to the acid, alcohol, phenol or amide is about 5-50:1.

The proportion of organic surface active agent which is used may vary widely, typically being from about 0.1 to 5% by weight of the total cleaning composition. When a disinfecting cationic surfactant is employed it is used in an amount sufficient to provide a concentration of at least about 300-1000 ppm in the bowl water. Thus a unit application of one of the bowl cleaners of the present invention would introduce about 0.025-2.0 g of surfactant into a standard toilet bowl.

The present two-envelope toilet bowl cleaners may also comprise a means for indicating when the inner bag has ruptured and/or the acidic material has been neutralized. Suitable means include the common acid-base indicators such as phenolpthalein, neutral red or cresyl purple which undergo a color change at a pH near neutrality. Thus, incorporation of a small amount of phenolpthalein powder in the outer envelope will yield a red bowl solution until rupture of the inner bag results in neutralization of the acidic material and discharge of the color. Alternatively, an amount of dye effective to color the bowl water, and thus to indicate that the basic material has been released and that the neutralization step is in progress, may be included in the inner envelope. Among dyes suitable for this purpose are Alphazurine 2G, Pylalkor Lavender 5-576, Napthol Green S-334, Turquoise Blue, Anthraquinone Blue, Alizarine Fast Blue and the like. Up to about 0.01-0.2% by weight of dye is preferred in the present compositions.

A minor amount of a perfume effective to mask bowl odors may also be included in the bowl cleaners of the present invention. Preferably, the perfume will comprise from about 0.1-0.5% by weight of the total cleaning composition present. Suitable fragrances are disclosed by E. Sagarin in *Cosmetics—Science and Technology*, John Wiley and Sons, N.Y. (1957) at pages 740-769, the disclosure of which is incorporated by reference herein, and include blends of odoriferous essential oils such as Essence 900A ® (Proprietary Perfumes, Inc.).

In order to increase the agitation or to agitate and foam the bowl water upon rupture of the outer envelope of the two-envelope cleaner system, a minor portion of the total basic material and optionally, all or a part of the surfactant may be mixed with the acidic material present in the outer envelope. If a portion of the basic material is admixed with the acidic material in the outer envelope, the bowl water will be agitated twice—first upon the opening of the outer envelope and for a second period upon opening of the inner envelope, which releases a portion of basic material suitable to complete the neutralization of the remaining acid. In like manner, this secondary agitation may be increased by including a minor portion of the acidic material within the inner envelope so that upon release of the inner envelope contents, the concentration of dissolved acid in the immediate vicinity of the dissolved base is thereby raised.

Preferably the ratio of neutralization equivalents of the acidic material to the neutralization equivalents of the portion of the basic material included therewith in the outer envelope will be about 6-2:1, most preferably from about 5.0-2:1 down to about 4.0-2:1. When a portion of the acidic material is included within the inner envelope as well, the ratio of neutralization equivalents of the basic material within the inner envelope to the neutralization equivalents of acidic material within the inner envelope will preferably be about 12-4:1, most preferably about 8-5:1. The ratio of neutralization equivalents of total base to the neutralization equivalents of total acid in the two-envelope systems will likewise be adjusted to about 5-1:1, preferably to about 4-1:1, and most preferably to about 2-1.25:1, so that the final bowl water pH is about 7-10, preferably about 8-9.5.

Thus, by admixing acidic material and basic material in one, or preferably both of the envelopes of the two-envelope cleaning system, the cleaning ability of the system may be increased. In such systems, a foam-forming amount of one of more surfactants may also be employed in either or both envelopes, so that when the neutralization reaction is initiated, a cleansing amount of foam is formed which acts to wet the bowl surfaces above the normal bowl water level.

Thus, a preferred embodiment of a one-envelope toilet bowl cleaner prepared according to the present invention would comprise a 1-3 mil polyvinyl alcohol envelope containing a mixture of about 10-50 g citric acid, 5-20 g sodium bicarbonate, 25-70 g sodium bisulfate, 10-20 g sodium carbonate and 0.5-3.0 g of sodium lauryl sulfate. Alternatively, an effective one-envelope system may comprise a mixture of 30-70 g sodium bisulfate, 5-15 g sodium carbonate, 5-10 g sodium bicarbonate and 0.05-3.0 g of a disinfectant mixture of $C_{12}$-$C_{18}$-n-alkyl(dimethyl)-benzyl ammonium chlorides.

Preferred embodiments of a two-envelope toilet bowl cleaner prepared according to the present invention may comprise an outer polyvinyl alcohol envelope having a thickness of 1-2 mil and containing a dry mixture of about 10-40 g citric acid, 5-20 g sodium bisulfate, 5-10 g sodium carbonate and 1.0-3.0 g of a disinfecting mixture of $C_{12}$-$C_{18}$ n-alkyl-(dimethyl)benzyl ammonium chlorides and an inner polyvinyl alcohol envelope of 3.0 mil wall thickness containing about 30-60 g of sodium bicarbonate, 2-10 g of citric acid, 0.05-0.02 g of dye and 0.1-0.2 g of perfume. Alternatively, the outer envelope may contain about 30-60 g sodium bisulfate, 3-10 sodium carbonate, 1-2 g sodium(-dodecyl)benzene sulfonate and 0.025-0.05 g of phenolpthalein as well as an inner pack containing about 5-15 g sodium bisulfate, 10-15 g sodium bicarbonate, and 20-30 g sodium carbonate. In a further embodiment of the two-envelope cleaner, the outer envelope may comprise about 20-50 g of sodium bisulfate, 3-10 g sodium carbonate and 0.1-0.2 g perfume as well as a 2.5 mil thick inner envelope containing about 20-30 g sodium carbonate, 5-15 g sodium bicarbonate, 5-15 g sodium bisulfate, 1-4 g of an about 1:1 mixture of $C_{12}$-$C_{18}$-n-alkyl-(dimethyl)benzyl ammonium chlorides and $C_{12}$-$C_{18}$n-alkyl-(di-methyl)ethylbenzyl . ammonium chlorides, 0.1-0.2 g perfume and 0.01-0.2 g of a dye.

The toilet bowl cleaners of the present invention may be prepared by any of the methods known in the art involving the formation of granular cleaning compositions and their introduction into water-soluble film envelopes. A useful procedure for preparing and filling polyvinyl alcohol envelopes with detergent compositions is disclosed in U.S. Pat. No. 3,528,921, the disclosure of which is incorporated by reference herein.

In a typical procedure to form a one-envelope bowl cleaning system, a sheet of the polymeric film is aspirated into a box- or pocket-shaped mold, and a mixture of the dry, granular or powdered components is placed within the pouch. If the surfactant is of a sticky or liquid constituency, it is first absorbed onto a portion of the granules of basic material, e.g., by spraying the melted or liquid surfactant onto a bed of moving or tumbling granules. The mixture is then encased within the envelope by heat or water sealing a lid of polymeric film over the envelope opening. When a two-envelope cleaning system is prepared, the components of the envelope will also include a smaller envelope which is prepared in a similar fashion and which is simply placed within the partially-filled outer envelope.

The invention will be further described by reference to the following detailed examples.

EXAMPLE I

A rectangle of 2.0 mil polyvinyl alcohol film (Baldwin-Montrose Chemical Co., Inc.—Mono-Sol Division) is placed over a depression in a hollow block. The depression is evacuated, thus drawing the central portion of the film into the depression and forming a pouch or open envelope therein. The envelope is filled with a dry mixture of 30 g citric acid, 12.5 g of sodium bicarbonate, 2.25 g of sodium lauryl sulfate, 47.5 g of sodium bisulfate and 15 g of sodium carbonate having absorbed thereon 2.0 g of (nonyl)phenoxypolyoxyethylene ethanol having a mole ratio of ethylene oxide to nonylphenol of 9.5:1. The edge portions of the film are moistened with water and a second piece of film is then aligned with the first piece and pressed against it to form a closed packet completely enveloping the composition contained therein. The moistened seal is dried with hot air, the vacuum is broken and the completed packet is removed from the mold.

EXAMPLE II

An envelope is prepared, filled and sealed as described in Example I to contain a dry mixture of 50 g sodium bisulfate, 10 g sodium carbonate, 7.5 g of sodium bicarbonate and 1.3 g of n-alkyl(dimethyl)benzyl ammonium chloride ($C_{14}$—93%; $C_{12}$—4%; $C_{16}$—3%). The envelopes of the toilet bowl cleaners of Examples I and II dissolve within 2.0 minutes when placed in 60° F. water in a standard-sized toilet bowl and the components react to agitate the bowl water and to foam it to a height of one-half inch above the normal water level. After the neutralization reaction is complete, the bowl water is of a sufficiently low pH to be effective for further cleansing of the bowl parts.

EXAMPLE III

A two-envelope bowl cleaner is prepared by applying the method of Example I to first prepare an inner envelope of 3.0 mil polyvinyl alcohol film containing 45 g of sodium bicarbonate, 6.0 g of citric acid, 0.1 g of Anthraquinone Blue dye and 0.15 g of Essence 900A perfume. The inner envelope is sealed within an outer, 1.5 mil polyvinyl alcohol film envelope which also contains 25 g of citric acid, 12.5 g of sodium bisulfate, and 1.5 g of n-alkyl(dimethyl)benzyl ammonium chloride ($C_{14}$—58%; $C_{16}$—28%; $C_{12}$—14%) which is preabsorbed onto 7.5 g of sodium carbonate granules.

EXAMPLE IV

A high-foaming, two-envelope cleaning system is prepared according to the procedure of Example III according to the following specifications:

A. Inner Envelope (2 mil film)
- 10 g sodium bisulfate
- 25 g sodium carbonate
- 12.5 g sodium bicarbonate B. Outer Envelope (1 mil film)
- 45 g sodium bisulfate
- 6.5 g sodium carbonate
- 1.5 g sodium dodecylbenzene sulfonate
- 0.1 g phenolpthalein indicator

EXAMPLE V

A two-envelope bowl cleaner which incorporates the surfactant in the inner envelope is prepared according to the procedure of Example III according to the following specifications:

A. Inner Envelope (2.5 mil film)
- 25 g sodium carbonate
- 10 g sodium bicarbonate
- 10 g sodium bisulfate 3.0 g 1:1 mixture of n-alkyl(dimethyl)benzyl ammonium chloride ($C_{14}$—60%; $C_{15}$—30%; $C_{12}$—5%; $C_{18}$—5%) and n-alkyl(dimethyl)ethylbenzyl ammonium chloride ($C_{14}$—60%; $C_{16}$—30%; $C_{12}$—5%; $C_{18}$—5%)

0.15 g Essence 900A perfume 0.015 g Turquoise Blue dye

B. Outer Envelope (1.5 mil film)

25 g sodium bisulfate 5.0 g sodium carbonate 0.15 g Essence 900A perfume

The outer envelopes of the toilet bowl cleaners prepared according to Examples III and IV dissolve in the bowl water within 1.5 minutes and the outer envelope chemicals react to foam the bowl contents. The indicator present in the outer envelope of Example IV colors the bowl water, whereas the bowl water treated with the cleaner of Example III remains clear. After 2.0 minutes, the inner envelopes of the cleaners rupture, and neutralize the bowl contents with further generation of carbon dioxide gas and some additional foaming. The dye incorporated within the inner envelope of the Example III cleaner dissolves to give a blue color to the bowl water, whereas neutralization of the remaining acid by the inner envelope contents of the cleaner of Example IV causes the bowl water to become clear, to thus indicate the completion of the cleansing reactions. A pH reading indicates that the bowl water is slightly alkaline after treatment with either cleaner.

The outer envelope of the bowl cleaner of Example V ruptures within 1.0 minutes in bowl water and the contents react to agitate the water and acidify it. After 2.0 minutes, the inner envelope ruptures, and the components react to agitate and foam the bowl contents while coloring and deodorizing the bowl water. A pH reading indicates that the bowl water is alkaline.

While certain representative embodiments of the invention have been described herein for purposes of illustration, it will be apparent to those skilled in the art that modifications may be made therein without departing from the spirit and scope of the invention.

We claim:

1. A double envelope toilet bowl cleaner comprising an outer, polymeric water-soluble envelope having therein an acidic material and an inner, polymeric water-soluble envelope having therein a basic material wherein the envelope containing the basic material is insoluble in the environment of the acidic material and wherein when said toilet bowl cleaner is placed in a toilet bowl the basic material is released into the bowl water subsequent to the release of and cleaning of the toilet bowl by the acidic material, and said acidic material interacts with said basic material in said bowl to release carbon dioxide gas and wherein the number of neutralization equivalents of said basic material are equal to or greater than the number of neutralization equivalents of said acidic material.

2. A double envelope toilet bowl cleaner comprising an outer, polyvinyl alcohol film envelope having therein an inner, polyvinyl alcohol film envelope which is insoluble in the environment of the outer envelope, a surfactant and a mixture of an acidic and a basic material wherein the ratio of the total number of neutralization equivalents of the acidic material to the total number of neutralization equivalents of the basic material in said outer envelope is about 6:1 to 2:1, and said inner envelope having therein a basic material wherein the basic material within the inner envelope is released into the bowl water subsequent to the release of and cleaning of the toilet bowl by the contents of the outer envelope and interacts with said acidic material and said surfactant to release an amount of carbon dioxide gas effective to agitate and foam said bowl water, and wherein the ratio of the total number of neutralization equivalents of said basic material to the total number of neutralization equivalents of said acidic materials is about 5:1 to 1:1.

3. The toilet bowl cleaner of claim 2 wherein the ratio of the neutralization equivalents of the acidic material to the neutralization equivalents of the portion of the basic material in admixture with the acidic material is about 2.5:1 to 2:1.

4. A double envelope toilet bowl cleaner comprising an outer, polyvinyl alcohol film envelope having therein an inner, polyvinyl film envelope which is insoluble in the environment of the outer envelope and a mixture of an acidic material and a basic material wherein the ratio of the number of neutralization equivalents of the acidic material to the number of neutralization equivalents of the basic material in said outer envelope is about 4:1 to 2:1, and said inner envelope having therein a mixture of an acidic material and a basic material wherein the ratio of the number of neutralization equivalents of the basic material within the inner envelope to the number of neutralization equivalents of the acidic material within the inner envelope is about 12:1 to 4:1, and wherein the contents of the inner envelope are released into the bowl water subsequent to the release of and cleaning of the toilet bowl by the contents of the outer envelope, and whereby carbon dioxide gas is generated upon the rupture of both the inner and outer envelopes in an amount effective to agitate the bowl water, and wherein the ratio of the total number of neutralization equivalents of said basic material to the total number of neutralization equivalents of said acidic material is about 5:1 to 1:1.

5. The toilet bowl cleaner of claim 4 wherein the ratio of neutralization equivalents of the basic material within the inner envelope to the neutralization equivalents of the acid material within the inner envelope is about 8:1 to 5:1.

6. The toilet bowl cleaner of claim 1 wherein the pH of the bowl water is about 7–10 after interaction of the acidic material with the basic material.

7. A toilet bowl cleaner comprising an outer, polyvinyl alcohol film envelope having therein an inner, polyvinyl film envelope, a mixture of an acidic material and a basic material wherein the ratio of the neutralization equivalents of the acidic material to the neutralization equivalents of the basic material in said outer envelope is about 4:1 to 2:1, and an amount of surfactant effective to foam the bowl water upon interaction of the acidic and basic materials in said outer envelope, and said inner envelope having therein a mixture of an acidic material and a basic material wherein the ratio of neutralization equivalents of the basic material within the inner envelope to the neutralization equivalents of the acidic material within the inner envelope is about 12:1 to 4:1, and wherein the contents of the inner envelope are released into the bowl water subsequent to the release of the contents of the outer envelope, and whereby carbon dioxide gas is generated upon the rupture of both the inner and outer envelopes in an amount effective to agitate the bowl water, and wherein the ratio of the total neutralization equivalents of said basic material to the total neutralization equivalents of said acidic material is about 4:1 to 1:1.

8. A toilet bowl cleaner comprising an outer, polyvinyl alcohol film envelope having therein an inner, polyvinyl film envelope and a mixture of an acidic material and a basic material wherein the ratio of the neutralization equivalents of the acidic material to the neutralization equivalents of the basic material in said outer envelope is about 4:1 to 2:1, and said inner envelope having therein a mixture of an acidic material and a basic material wherein the ratio of neutralization equivalents of the basic material within the inner envelope to the neutralization equivalents of the acidic material within the inner envelope is about 12:1 to 4:1, and an amount of surfactant effective to foam the bowl water upon interaction of the acidic and basic materials in said inner envelope, and wherein the contents of the inner envelope are released into the bowl water subsequent to the release of the contents of the outer envelope, and whereby carbon dioxide gas is generated upon the rupture of both the inner and outer envelopes in an amount effective to agitate the bowl water, and wherein the ratio of the total neutralization equivalents of said basic material to the total neutralization equivalents of said acidic material is about 5:1 to 1:1.

9. The toilet bowl cleaner of claim 7 or 8 wherein the surfactant comprises a n-higher(alkyl)dimethylbenzyl ammonium salt and a n-higher(alkyl)dimethyl (ethylbenzyl)ammonium salt.

10. The toilet bowl cleaner of claim 7 or 8 wherein the surfactant is present in an amount effective to substantially disinfect said bowl water.

11. The toilet bowl cleaner of claim 7 or 8 wherein the acidic material is selected from the group consisting of citric acid, sulfamic acid, oxalic acid, tartaric acid and mixtures thereof.

12. The toilet bowl cleaner of claim 11 wherein the acidic material comprises sodium bisulfate or sodium bisulfite.

13. The toilet bowl cleaner of claim 7 or 8 wherein the basic material is selected from the group consisting of a carbonate salt, a bicarbonate salt and mixtures thereof.

14. The toilet bowl cleaner of claim 1 wherein the outer envelope is 1–2 mm thick and the inner envelope is 1.5–3 mm thick.

15. The toilet bowl cleaner of claim 1 wherein the ratio of neutralization equivalents of the basic material to the neutralization equivalents of the acidic material is about 2:1 to 1.25:1.

16. The toilet bowl cleaner of claim 1 further comprising an amount of an indicator effective to indicate neutralization of the acidic material via a color change.

17. The toilet bowl cleaner of claim 13 wherein the ratio of neutralization equivalents of the carbonate salt to the neutralization equivalents of the bicarbonate salt is about 2:1.

18. The toilet bowl cleaner of claim 1 further comprising an amount of dye effective to color the bowl water upon rupture of the inner envelope.

* * * * *